US006349183B1

(12) United States Patent
Nagamine et al.

(10) Patent No.: US 6,349,183 B1
(45) Date of Patent: Feb. 19, 2002

(54) IMAGE FORMING APPARATUS

(75) Inventors: Kiyoshi Nagamine; Yoshifumi Ozaki; Toru Ishikawa; Hiroshi Kawarazuka, all of Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/721,947

(22) Filed: Nov. 27, 2000

(30) Foreign Application Priority Data

Apr. 27, 2000 (JP) ..... 2000-128335

(51) Int. Cl.[7] ..... G03G 15/08; G03G 15/00
(52) U.S. Cl. ..... 399/27; 399/49
(58) Field of Search ..... 399/27, 28, 29, 399/49

(56) References Cited

U.S. PATENT DOCUMENTS

| | | | | |
|---|---|---|---|---|
| 5,351,107 A | * | 9/1994 | Nakane et al. | 399/49 |
| 5,402,209 A | * | 3/1995 | Itoyama et al. | 399/46 |
| 5,768,652 A | | 6/1998 | Janssens et al. | 399/14 |
| 6,029,021 A | * | 2/2000 | Nishimura et al. | 399/49 |
| 6,226,463 B1 | * | 1/2001 | Phillips et al. | 399/24 |
| 6,275,664 B1 | * | 8/2001 | Wolf et al. | 399/27 X |

FOREIGN PATENT DOCUMENTS

| | | |
|---|---|---|
| JP | 9-152779 | 6/1997 |
| JP | 43-16199 | 7/1998 |

* cited by examiner

*Primary Examiner*—Fred L. Braun
(74) *Attorney, Agent, or Firm*—Morgan, Lewis & Bockius LLP

(57) ABSTRACT

An image forming apparatus includes a toner supply for supplying toner to the developing unit; a toner supply control device for determining the final amount of toner supply, on the basis of the standard amount of toner supply corresponding to image coverage and a change in the amount of toner supply corresponding to the density of an image, thereby controlling the toner supply; a toner supply history storage device for storing a history concerning the amount of toner supplied; a toner consumption status determination device for determining whether or not an excessive amount of toner is consumed, on the basis of the toner supply history information; and development property stabilization device which interrupts formation of an image when the toner consumption status determination device determines that an excessive amount of toner is consumed, thereby causing the toner supply to supply toner and causing the developing unit to agitate and blend a developing agent or to temporarily agitate and blend a developing agent.

8 Claims, 12 Drawing Sheets

IMAGE FORMING APPARATUS

BACKGROUND OF THE INVENTION

1. Field of the Invention

The present invention relates to an image forming apparatus, such as a copier, a printer, or a facsimile receiver, and more particularly, to an improved image forming apparatus which has a developing unit for rendering a latent image visible through use of a two-component developing agent consisting of a carrier and toner and has toner supply means for supplying toner to the developing unit.

2. Description of the Related Art

An electrophotographic image forming apparatus is taken as an example of a common image forming apparatus, such as a copier, a printer, or a facsimile receiver. In a known type of electrophotographic image forming apparatus, a latent image is formed on an image carrier, such as a photosensitive drum, and a developing unit renders the latent image visible.

Various types of development methods have hitherto been employed by developing units. A typical development method having a superior development property employs a development roller disposed opposite the image carrier. A two-component developing agent mainly consisting of toner and a carrier is applied to the development roller by means of a magnetic brush. The developing agent having the form of a magnetic brush is located in close proximity, to (in a non-contact manner) or so as to come into contact with he image carrier, whereby the developing agent renders visible the latent image formed on the image carrier.

In the two-component developing unit using a two-component developing agent of this type, toner is consumed every time a developing operation is performed, thereby inducing a decrease in the amount of toner supplied to a development region at which the image carrier opposes the development roller. Thus, replenishment of toner is required in association with consumption of toner.

There has already been proposed a toner replenishing control method (described in, for example, Japanese Patent Publication 16199/1968). According to this method, a reference patch potential of an image carrier, for example, is detected from the density of a developed image through use of an image density detector. If the result of detection shows that the density of the image is less than a predetermined density, replenishment of toner is performed.

A developing agent supplied to the development region for developing purpose requires that a development roller be frictionally electrified sufficiently and uniformly in the axial direction thereof. A two-component developing unit is usually provided with an agitation-blending mechanism for sufficiently agitating and blending toner and a carrier stored in the developing unit.

In a case where a plurality of items of printed matter containing high-coverage images are continuously produced, the two-component developing unit of this type must be newly replenished with a large quantity of toner. Electrification of newly-supplied toner lags behind a development operation. As a result, development of a latent image and transfer of a developed image are performed through use of insufficiently-electrified toner, potentially leading to a fear of various detriments, such as, inconsistencies indensity, occurrence of a toner dust cloud, fog, or deterioration of image resolution.

Particularly, in a case where images to be continuously printed are smaller than the full length of the development roller in its axial direction (i.e., images are narrower than the maximum print size), consumption of a developing agent arises locally with reference to the axial direction of the development roller. As a result, a steep gradient of toner density arises across the length of the development roller with reference to the axial direction thereof, thereby deteriorating uniformity of image density.

As the technique for resolving the drawback. of the background art, there has already been proposed a method for realizing he uniform distribution of toner and uniform frictional electrification, by means of interrupting an electrophotographlc image formation process on the basis of, for example, an image area coverage; performing operation pertaining to a cycle of activating and mixing an extra developer; and blending and agitating a two-component developing agent.

According to the method of this type, in a case where high-coverage images are continuously printed, an electrophotographic image formation process is temporarily interrupted, and replenishment of toner and agitation and blending of a developing agent are sufficiently performed. As a result, density of toner and the electrification characteristic of toner are maintained properly, thus enabling sustainment of good picture quality.

This prior art encounters difficulty in solving the following technical drawbacks.

The above-described technology is based on the premise that toner is supplied in accordance with the size of the image coverage area. There is a potential fear that the quantity of toner might change in accordance with a change in the development property of a developing agent associated with a change in the electrification characteristic of toner due to a change in environment (changes in temperature and humidity) and deterioration of a developing agent.

A commonly-employed method is for controlling a toner supply volume by means of controlling the period of time during which a toner supply unit is activated. Further, there is a potential fear that the quantity of toner supplied per unit time may change in accordance with a change in environment or the amount of toner remaining in a toner storage tank, such as a toner cartridge.

A conceivable method of ensuring sufficient image density and good uniformity of image density across the length of the development roller is to set a smaller image area coverage beforehand in expectation of a variation in the quantity of toner consume or the quantity of toner supply or to set a shorter time period after which the process of forming an electrophotographic image is interrupted (the number of images to be continuously produced).

In this case, productivity of an image forming apparatus (the number of images formed per predetermined time period) is considerably deteriorated.

SUMMARY OF THE INVENTION

The present invention has been conceived to solve the foregoing technical problems with the background art and is aimed at providing an image forming apparatus which can maintain the excellent development property of a two-component development unit at all times without involvement of an unnecessary decrease in productivity even in a case where images of high coverage are continuously formed.

To achieve the above object, according to the present invention, there is provided an image forming apparatus including latent image formation means for forming an electrostatic latent image on an image carrier and a developing unit for rendering the electrostatic latent image visible through use of a two-component developing agent consisting of at least a carrier and toner, the apparatus comprising:

toner supply means for supplying toner to the developing unit;

toner supply control means for determining the final amount of toner supply, on the basis of the standard amount of toner supply corresponding to image coverage measured by image coverage measurement means and a change in the amount of toner supply corresponding to the concentration of an image detected by image concentration detection means 6, thereby controlling toner supply means;

toner supply history storage means for storing a history concerning the amount of toner to be supplied by the toner supply means;

toner consumption status determination means for determining whether or not an excessive amount of toner is consumed, on the basis of the toner supply history information supplied from the toner supply history storage means; and development property stabilization means which interrupts formation of an image when the toner consumption status determination means determines that an excessive amount of toner is consumed, thereby causing the toner supply means to supply toner and causing the developing unit to agitate and blend a developing agent or to temporarily agitate and blend a developing agent.

The latent image formation means is not limited to latent image formation means of electrophotographic type, so long as latent image formation means can form an electrostatic latent image on the image carrier. Latent image formation means of another type, such as latent image formation means of electrostatic recording type, may be selected as the latent image formation means, as required. Further, as required, any developing unit may be selected as the developing unit, regardless of whether the developing unit is of monochrome type or color type or whether or not the developing unit is of trickle type.

When replenished with toner, the developing unit of two-component development type must electrify new toner with a predetermined voltage. The developing unit is usually provided with a developing agent agitation-blending mechanism for agitating and blending an existing developing agent and newly-supplied toner.

The toner supply means is not limited to a cartridge type; any type of toner supply means may be selected, as required, so long as the toner supply means replenishes the developing unit with toner.

The toner supply control means may adopt any algorithm, so long as determination of the final amount of toner supply can be effected through use of the standard amount of toner supply corresponding to image coverage and a change in the amount of toner supply corresponding to the concentration of an image.

The image coverage measurement means for measuring image coverage may be arranged so as to measure image coverage on the basis of an electrostatic latent image formed on the image carrier or a photo image formed by means of rendering the electrostatic latent image visible. Alternatively, the image coverage measurement means may be arranged so as to measure image coverage by utilization of an image signal to be used for writing an electrostatic latent image.

Any means may be selected as the image concentration detection means for detecting the concentration of an image, as required: for example, means for detecting the concentration of a reference image for use in detecting a concentration formed on the image carrier or means for detecting the proportion of toner contained in the developing agent stored in the developing unit, so long as the image concentration detection means can directly or indirectly detect the concentration of an image.

The toner supply control means may selectively determine when to supply the determined amount of toner or a unit in which toner is to be supplied.

The expression "amount of toner supply" means all the types of quantity of toner supply which enable direct or indirect ascertainment of the amount of toner supply. In view of ease of handling, the amount of toner supply is expressed by a time period during which the toner supply means is to be activated, or the number of rotations of drive elements of the toner supply means.

The toner supply history storage means enables storage of a history concerned with the amount of toner which had been supplied during a certain period of time, for the purpose of ascertaining the state of toner consumption.

Preferably, information about the amount of toner which had really been supplied over at least a certain period of time is stored as history information. From the viewpoint of more accurate ascertainment of the amount of toner to be supplied essentially, the toner supply history storage means preferably has means for storing the amount of deficient toner supply which should have been supplied in the past but has not been supplied, the amount of excessive toner supply which should have been reduced in the past but has not been reduced, or the result of addition of the amount of deficient toner supply and the amount of excessive toner supply.

The expression "the excessive consumption of toner" determined by the toner consumption state determination means, for example, a case where high-coverage images are continuously formed. In such a state, toner is excessively consumed to such an extent that ordinary toner supply cannot keep pace with consumption of toner. As a result, irregularities in the electrification characteristic of toner cause a failure in picture quality, or a deficiency of toner induces print failures.

A determination as to whether or not consumption of toner is excessive is basically made on the basis of whether or not the quantity of toner consumed during a predetermined period of time exceeds a predetermined amount. Various situations lead to excessive consumption of toner. From the viewpoint of more correct determination of excessive consumption of toner, excessive consumption of toner is preferably determined in several phases on the basis of a history concerning the amount of toner supplied during different periods of history; for example, the phase of excessive consumption of toner abruptly arising in a short period of time; the phase of excessive consumption of toner gradually arising over a certain period of time; and the phase of excessive consumption of toner arising during an intermediate period of time.

The development property stabilization means may be embodied as any means, so long as the means interrupts formation of an image when it is determined that toner is excessively consumed, thus stabilizing the development property of a developing agent. Stabilization of development property of a developing agent is typically effected by means of the toner supply means supplying toner and the developing unit agitating and blending a developing agent. Alternatively, stabilization of development property of a developing agent may be effected by means of only the developing unit agitating and blending a developing agent.

From the viewpoint of avoiding a useless operation, the development property stabilization means preferably detects the concentration of an image through use of the image concentration detection means. In a case where the concentration of the image does not reach a target concentration level, the toner supply means preferably supplies toner, and the developing unit 3 preferably agitates and blends a developing agent or temporarily agitates and blends a developing agent.

In a case where emphasis is placed on stabilization of a development property, if the toner consumption state determination means determines that toner is excessively consumed, the development property stabilization means interrupts formation of an image. Subsequently, the image concentration detection means detects the concentration of an image. In a case where a target image concentration level is achieved, the developing unit preferably temporarily agitates and blends a developing agent.

Preferably, the toner supply history storage means has means for storing the amount of deficient toner supply which should have been supplied in the past but has not been supplied.

Preferably, the toner supply history storage means has means for storing the amount of excessive toner supply which should have been reduced in the past but has not been reduced.

Preferably, the toner supply history storage means has means for storing the result of addition of the amount of deficient toner supply which should have been supplied in the past but has not been supplied and the amount of excessive toner supply which should have been reduced in the past but has not been reduced.

DETAILED DESCRIPTION OF THE PREFERRED EMBODIMENTS

A preferred embodiment of the present invention will be described in detail by reference to the accompanying drawings.

Figure 2:
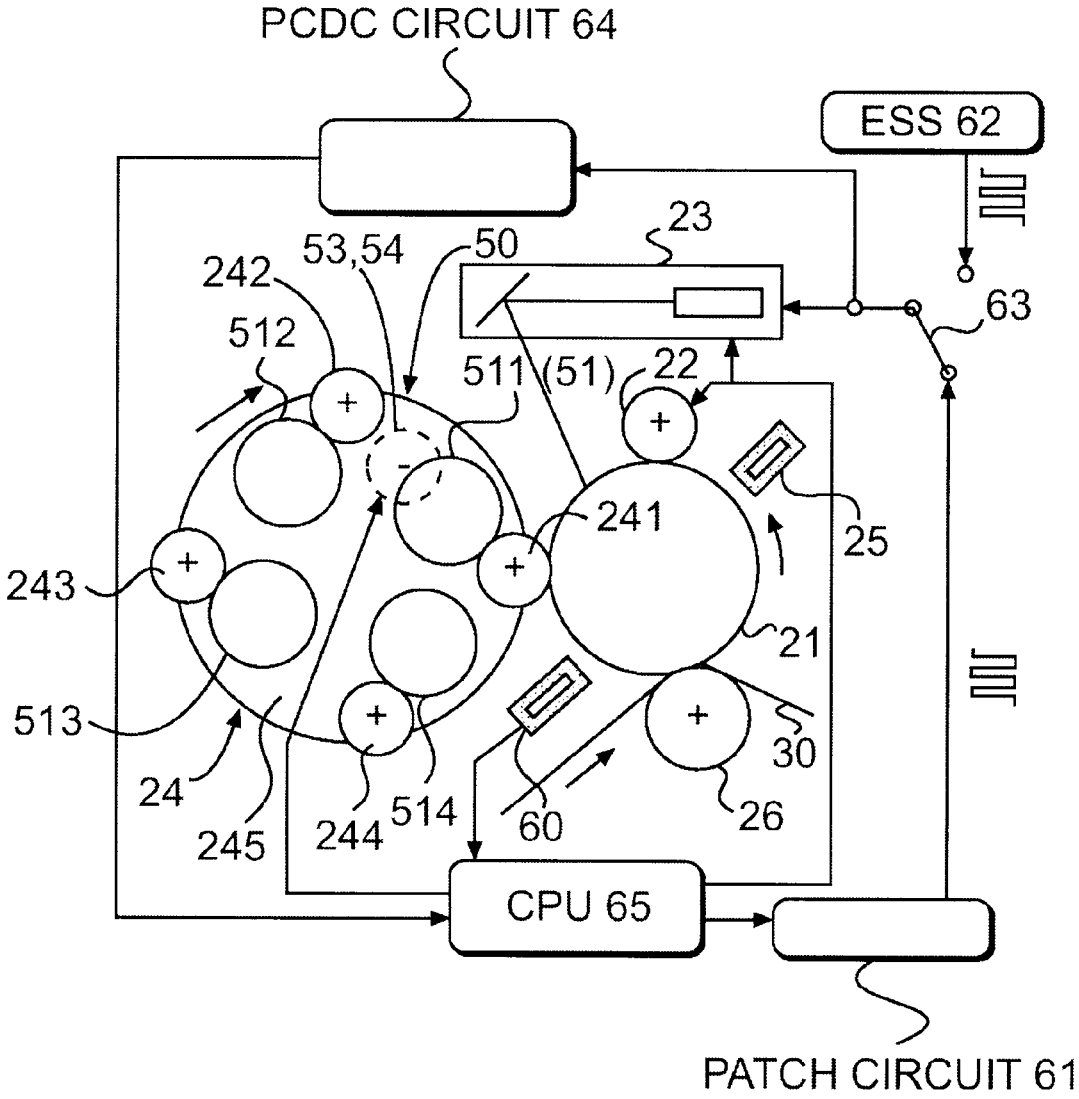
FIG. 2 is a schematic representation showing the configuration of the entirety of the image forming apparatus according to an embodiment of the present invention.

FIG. 2 is a diagram showing an image forming apparatus according to an embodiment of the present invention. Reference numeral 21 designates a photosensitive drum (image carrier) rotating in he direction designated by an arrow; 22 designates an electrification device, such as an electrification roller, for electrifying the photosensitive drum 21 beforehand; 23 designates an image writing device, such as a laser scanner (e.g., a raster output scanner, ROS) ,for writing electrostatic latent images of respective colors on the photosensitive drum 21; and 24 designates a rotary developing unit. Developing devices 241 to 244 assigned to colors; i.e., yellow (Y) , magenta (M), cyan (C), and black (K), are provided in a rotary holder 245. The electrostatic latent images formed on the photosensitive drums 21 are developed by means of corresponding developing devices 241 to 244, thereby producing toner images of respective colors. Reference numeral 25 designates a diselectrification device, such as a diselectrification lamp, for removing residual electric charges from the photosensitive drum 21. Residual toner is removed from the photosensitive drum 21 by means of an unillustrated drum cleaner.

Reference numeral 30 designates an intermediate transfer belt to be brought into contact with the surface of the photosensitive drum 21. The intermediate transfer belt 30 is rotated in (the direction designated by an arrow while being extended over a plurality of rollers (hereinafter often referred to as "extension rollers").

A primary transfer device 26 (a primary transfer roller according to the present embodiment) is provided on the reverse side of the intermediate transfer belt 30 opposing the photosensitive drum 2l. A voltage which is opposite in polarity to the electric charges of toner is applied to the primary transfer roller 26, whereby a toner image formed on the photosensitive drum 21 is electrostatically attracted.

An unillustrated secondary transfer device (i.e., a secondary transfer roller in the present embodiment) is disposed at a position opposite one of the extension rollers over which the intermediate transfer belt 30 is extended. By means of application, to the secondary transfer roller, of a voltage which is opposite in polarity to the electric charge of toner, a primary transfer image transferred onto an intermediate transfer belt 30 is transferred to an unillustrated recording sheet through secondary transfer operation.

Figure 3:
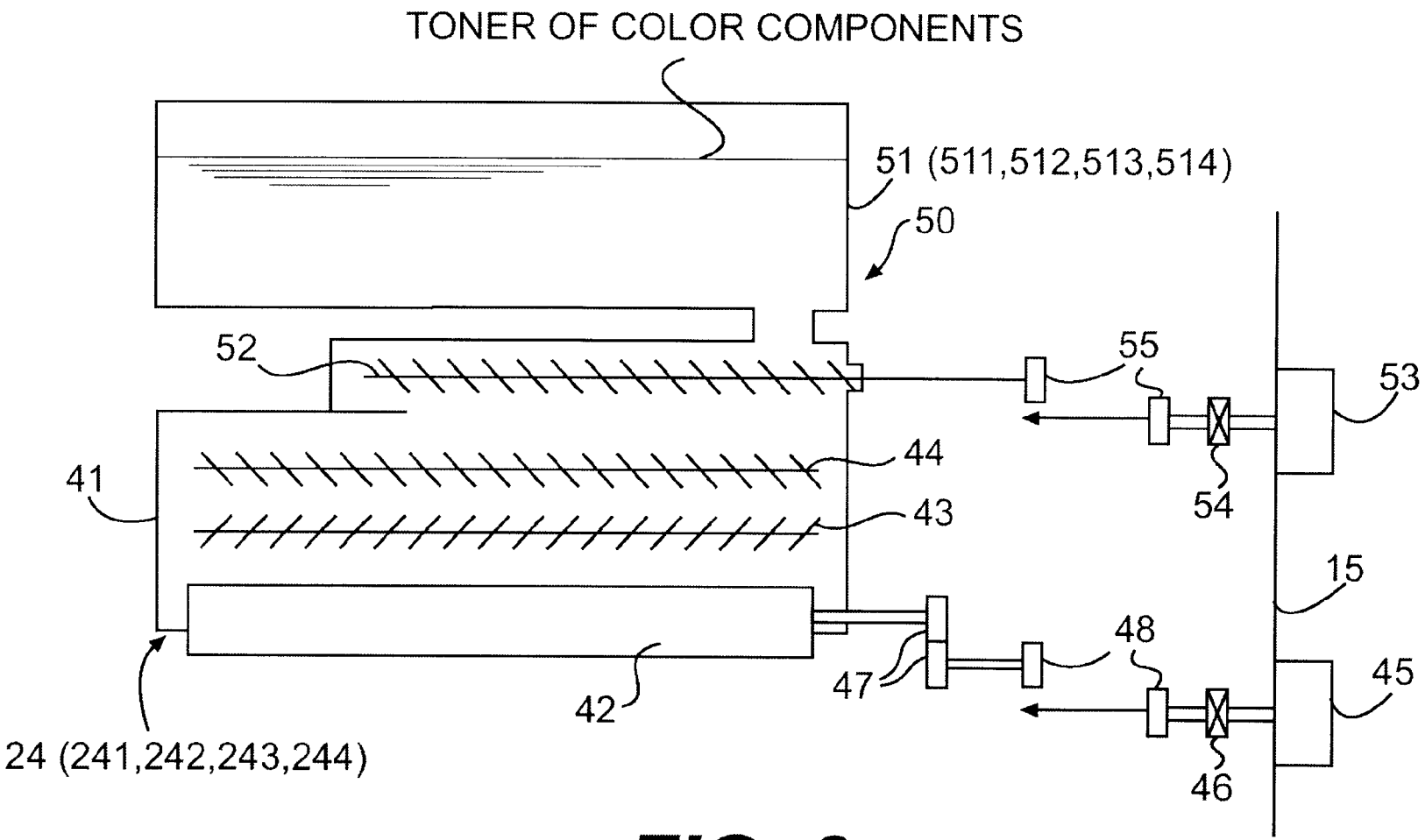
FIG. 3 is a schematic representation showing details of a developing unit and a toner dispenser employed in the embodiment.

As shown in FIG. 3, in the present embodiment, each of the developing devices 241 to 244 of the rotary developing unit 24 has an opening opposite the photosensitive drum 21 and is equipped with a development housing 41 storing a two-component developing agent consisting of at least toner and a carrier. A development roller 42 is provided in each of the openings of the development housing 41. A pair of augers 43 and 44 are provided on the back of the development roller 42 for mixing and blending a developing agent.

A development motor 45 is provided on an image forming apparatus main unit 15. Driving force originating from the development motor is transmitted to the development roller 42 by way of a development clutch 46 and driving-force transmission gears 47 and 48. Further, the driving force is transmitted to the augers 43 and 44 by unillustrated driving-force transmission gears.

The rotary developing unit 24 is provided with a toner replenishing device 50. As illustrated in FIGS. 2 and 3, the toner replenishing device 50 has a toner cartridge 51 (comprising cartridges 511 through 514). The toner cartridges 511 through 514 are provided for respective developing devices 241 through 244 and store toner of colors. The toner replenishing device 50 has a dispense auger 52 for supplying toner from the inside of the toner cartridge 51 to any one of the corresponding developing devices 241 to 244. Driving force originating from a dispenser motor 53 provided on the image forming apparatus main unit 15 is transmitted to the dispense auger 52 by way of a dispense clutch 54 and a drive transmission gear 55.

A concentration sensor 60 is provided in a downstream position relative to a point where the rotary developing unit 24 opposes the photosensitive drum 21 and in an upstream position relative to a primary transfer area. The concentration sensor 60 detects the density of a reference patch (not shown) for use in detecting the density of an image formed on the photosensitive drum 21.

In FIG. 2, reference numeral 61 designates a patch circuit for forming a reference patch during a process control cycle; 62 designates an electric sub-system (ESS) for producing image signals of color components; 63 designates a changeover switch for selectively supplying an output from the patch circuit 61 or an output from the ESS 62 to the image writing device 23; and 64 designates a pixel count dispense control (PCDC) circuit for counting the number of pixels on the basis of the image signal output from the ESS 62 and converting the number of pixels into a pixel count value corresponding to a predetermined number of pixels.

In the present embodiment, a CPU 65 captures a signal from, for example, the density sensor 60 and the PCDC circuit 64, thereby performing a dispense control operation to be described later (see FIGS. 4 through 7) and a cycle down operation during a printing operation (see FIGS. 8 through 10). Control signals are delivered at predetermined timings to the patch circuit 61, dispenser drive sources of the toner replenishing device 50 (a dispenser motor 53 and a dispense clutch 54) , the electrification device 22, and the image writing device 23.

The operation of the image forming apparatus according to the present embodiment will now be described.

Dispense control operation; that is, control of toner supply to the developing unit, will now be described by reference to FIGS. 4 through 7 and FIG. 11A.

The CPU 65 commences color printing operations and checks the content of SUM_DISP, which is a storage buffer for storing the amount of toner dispensed at a point in time when PAGE SYNC (a signal representing the starting position of a page of an image signal) is turned ON (see FIG. 11A) and at predetermined intervals thereafter (e.g., every 1000 ms in the present embodiment).

A determination is made as to whether or not SUM_DISP is greater than a dispense unit time (e.g., 1000 ms. in the present embodiment) . If SUM_DISP is greater than the dispense unit time, the dispenser motor 53 of corresponding color is activated only for a dispense unit time (i.e., the dispenser motor 53 is turned on, and the dispense clutch 54 is turned on). In contrast, if SUM_DISP is less than the dispense unit time, nothing is performed.

The dispenser motor 53 is activated only in a period of time during which the development clutch 46 is turned on.

A determination is made as to whether or not the dispenser motor 53 is activated for only a dispense unit time. In contrast, if the dispenser motor 53 is activated only for the dispense unit time, the dispense unit time is subtracted from SUM_DISP.

In contrast, if the development clutch 46 is turned off before the dispenser motor 53 is activated only during a dispense unit time, a remaining time is returned to SUM_DISP.

These operations are performed until a printing operation is completed.

Figure 5:
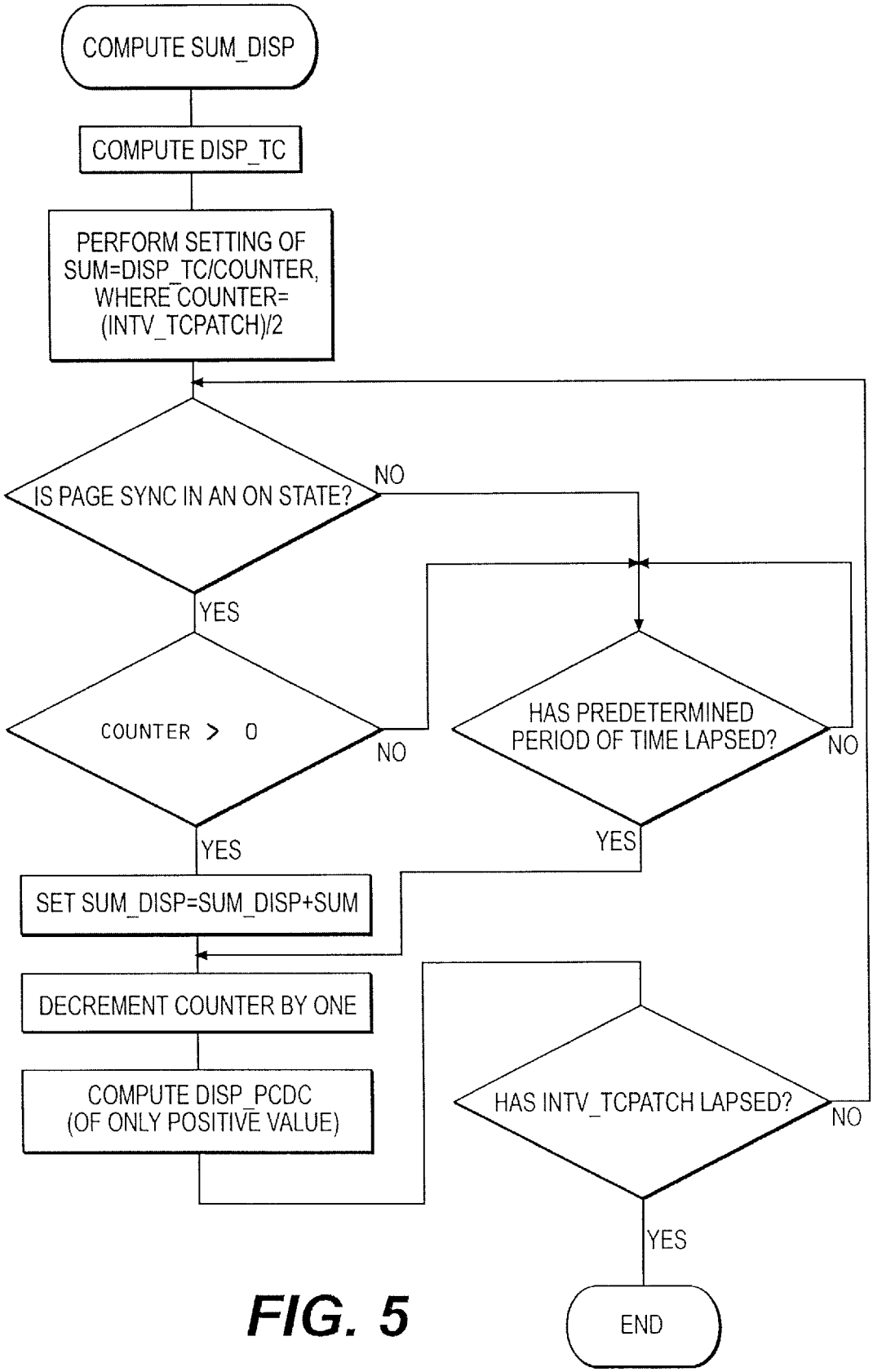
FIG. 5 is a flowchart showing an example of computation of SUM_DISP shown in FIG. 4.

Computation of SUM_DISP used in the present embodiment will now, be described by reference to FIG. 5.

As shown in the drawing, the CPU 65 first computes DISP_TC.

Figure 1:
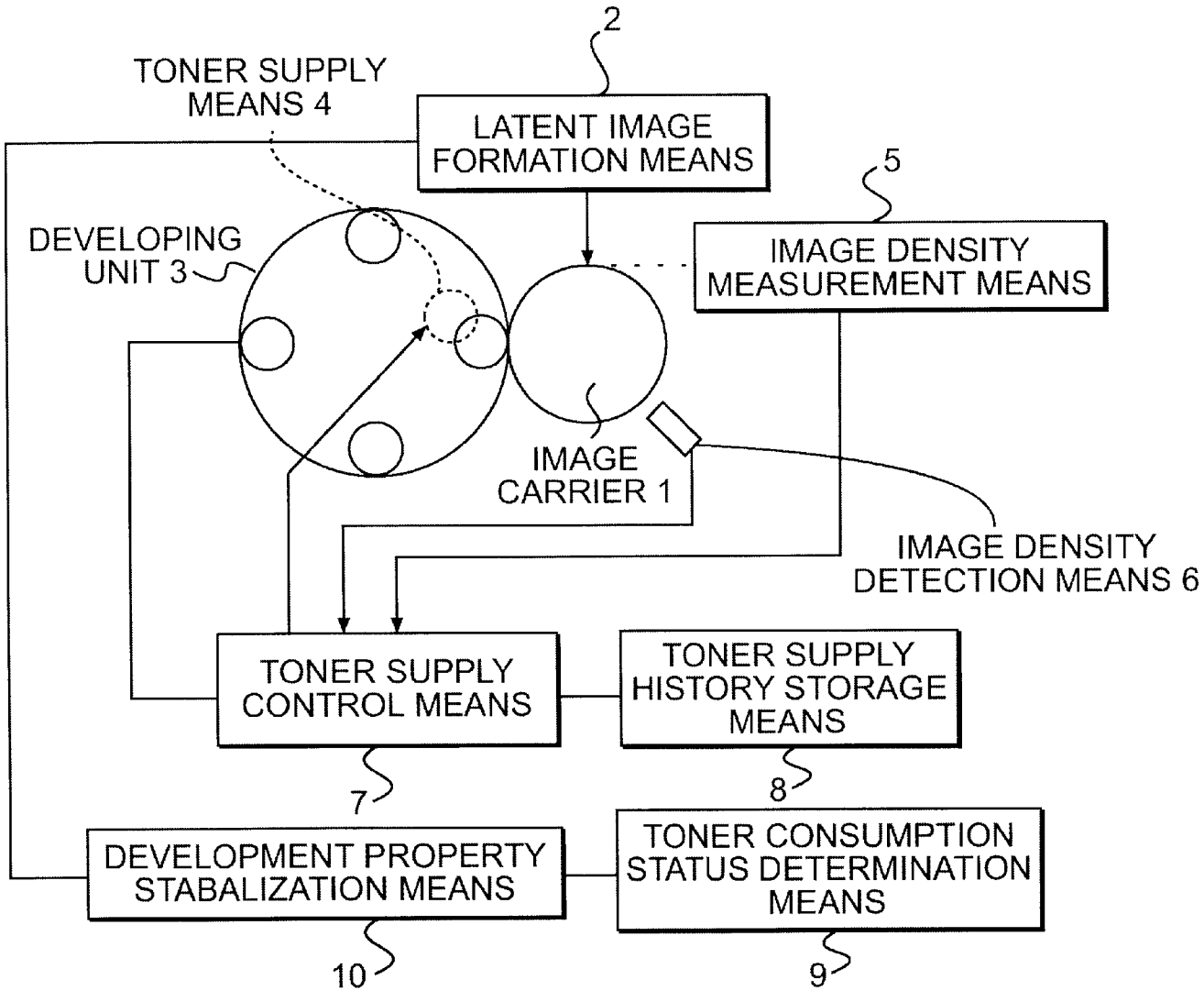
FIG. 1 is an illustration for describing the outline of an image forming apparatus according to the present invention.
Figure 6:
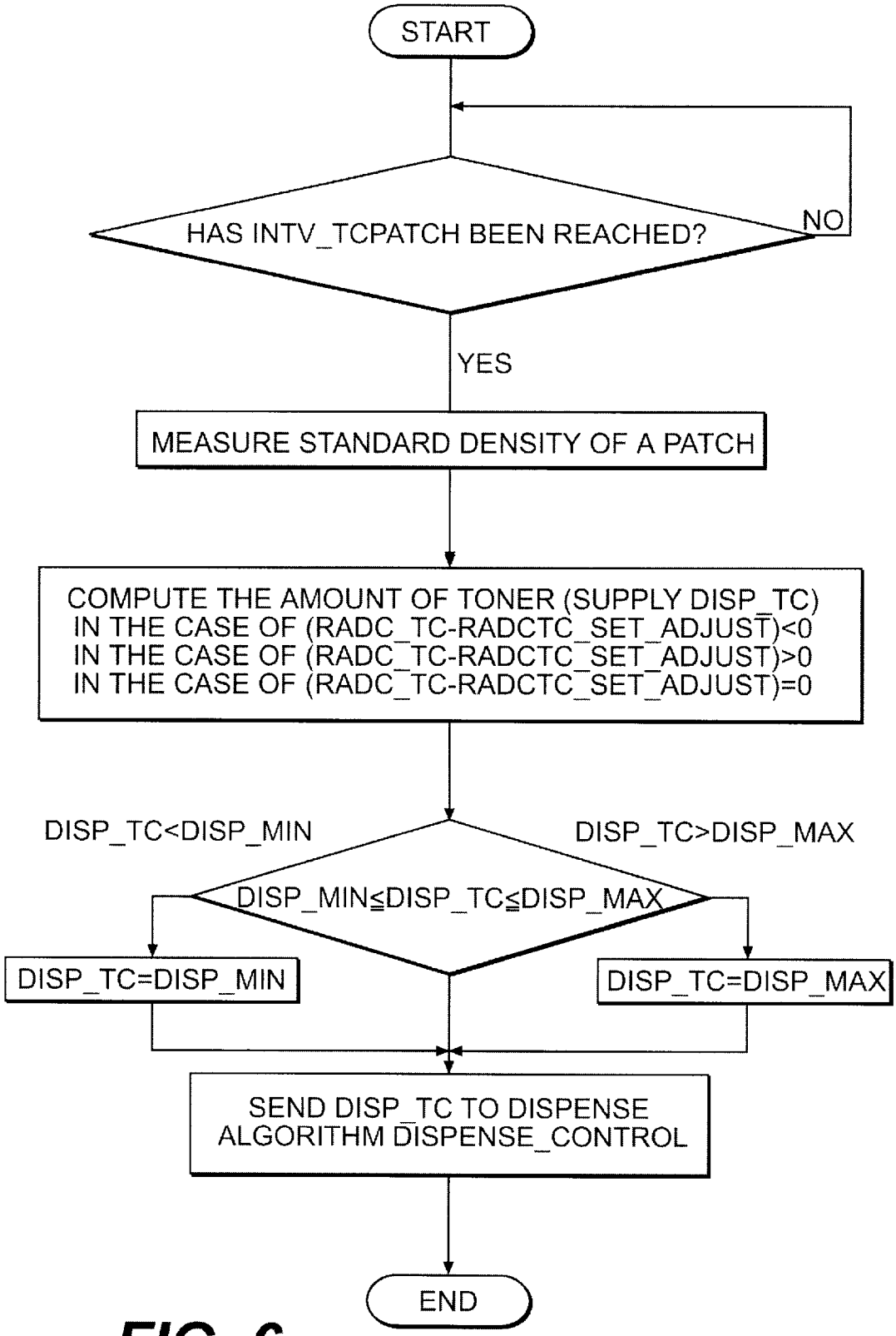
FIG. 6 is a flowchart showing an example of computation of SUM_TC shown in FIG. 5.

As shown in FIG. 6, DISP_TC means the amount of toner supply determined on the basis of information about the density of a reference patch prepared during a process control cycle (see FIG. 1A) which is periodically performed at predetermined intervals (INTV_TC PATCH: 20 sheets of JIS-standard A3-size paper in the present embodiment).

A determination is made as to whether a difference between the density level read by the density sensor 60 (RADC_TC) and a predetermined density level (FADCTC_SET_ADJUST) is positive, negative, or zero. In a case where the difference is negative (i.e., in a case where the read density level is low), DISP_TC is defined as DISP_TC=the difference $x-\alpha$. In contrast, in a case where the difference is positive (i.e., the read density level is high) , DISP TC is defined as DISP_TC=the difference x $\alpha'$. In a case where the difference is 0, DISP_TC=0.

If the thus-computed "DISP_TC" falls within the predetermined range of the minimum DISP_MIN to the maximum DISP_MAX, the computed value is used as is. If "DISP_TC" falls outside the range of the minimum DISP_MIN to the maximum DIP_MAX, DISP_TC is replaced with either the minimum DISP_MIN or the maximum DISP_MAX, and the thus-replaced value is delivered to a dispense algorithm (DISPENSE_CONTROL).

In this state, the CPU 65 performs setting of SUM= DISP_TC/counter.

Here, counter=(INTV_TCPATCH)/2 and corresponds to ten sheets of JIS-standard A??3??-size paper in the present embodiment.

SUM means a value determined by means of dividing the amount of toner supply based on information about a density detected during a process control cycle by the amount of toner used for printing ten sheets of A3-size paper.

If counter >0 at a point in time PAGE SYNC. enters an ON state, the CPU 65 sets SUM_DISP =SUM_DIP +SUM, thereby decrementing the counter by one.

When PAGE SYNC. is in an ON state at predetermined intervals thereafter (every 1000 ms. in the present embodiment), the CPU 65 computes DISP_PCDC (of only a positive value).

DISP_PCDC means the amount of toner supply corresponding to the number of pixels. For instance, DISP_PCDC is computed through processing shown in FIG. 7.

Figure 7:
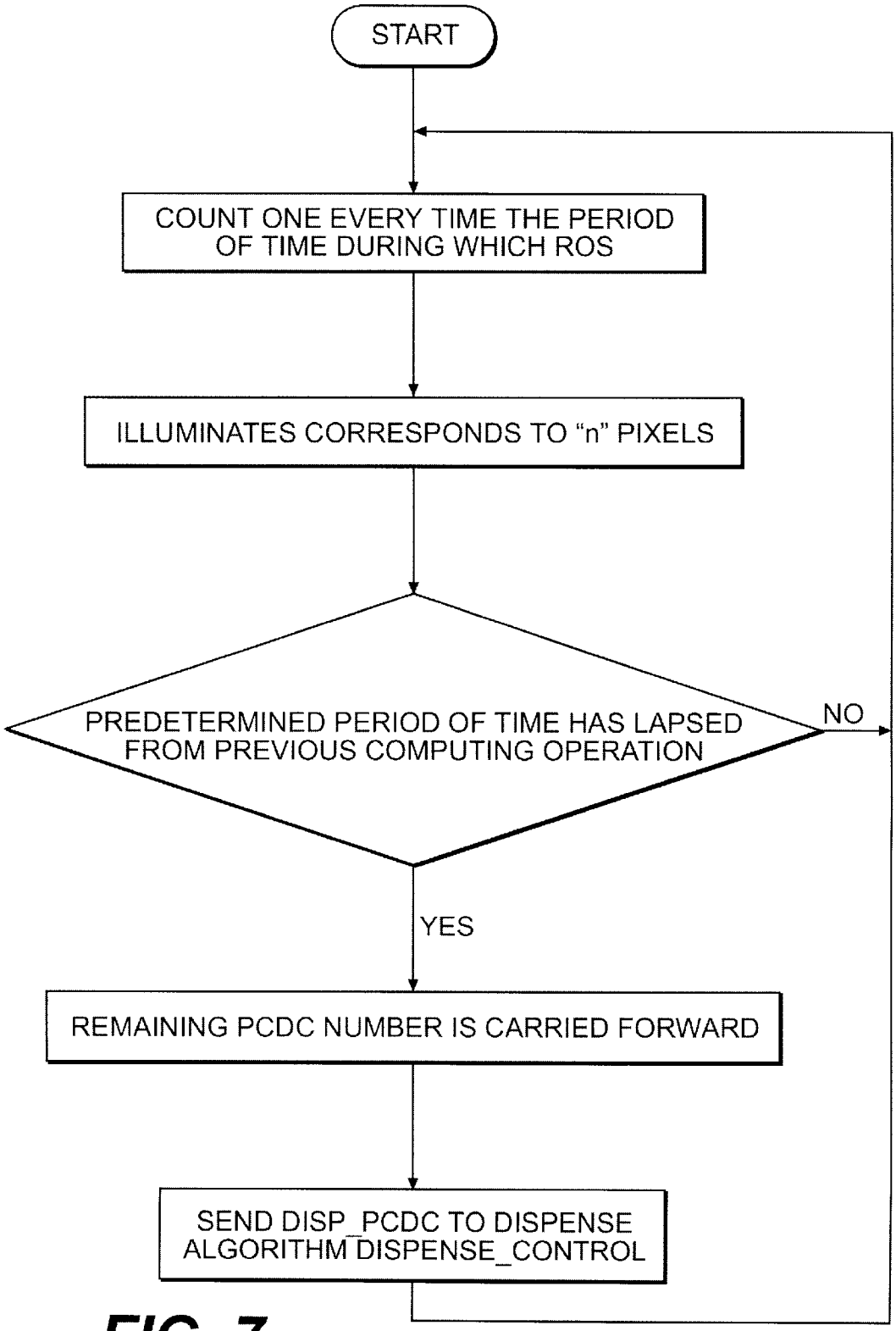
FIG. 7 is a flowchart showing an example of computation of SUM_PCDC shown in FIG. 5.

As shown in FIG. 7, the PCDC circuit 64 integrates an electric current of an illumination signal output from a ROS which is the image write device 23, in analog fashion. Every time the period of time during which the ROS illuminates corresponds to "n" pixels (where "n"=170) , one count (1 PCDC) is output.

The CPU 65 sets PCDC_CTR (PCDC counter)=PCDC_CTR+LPCDC and checks whether or not a predetermined period of time (1000 ms in the present embodiment) has lapsed from a previous computing operation. If the predetermined period of time has lapsed, the CPU 65 computes DISP_PCDC=$\beta$•PCDC_CTR (where $\beta$ is a proportional coefficient) . The result of computation is delivered to the dispense algorithm (DISPENSE_CONTROL).

A remaining PCDC number is carried forward.

In this state, the CPU 65 computes SUN_DISP=SUM_DISP+DISP_PCDC, thereby determining the final amount of toner supply consisting of a change in the amount of toner supply based on the density of an image and the standard amount of toner supply based on the number of pixels.

These operations are repeated in the same manner, until INTV_TCPATCH lapses.

In the present embodiment, replenishment of toner is performed on the basis of density information during the first half of the period of an interval between process control cycles. Therefore, replenishment of toner can be immediately commenced even when a change arises in the density of an image. Alternatively, replenishment of toner may be performed for compensating for a change in the density of an image, in an averaged manner over the entire period of an interval between process control cycles.

Figure 8:
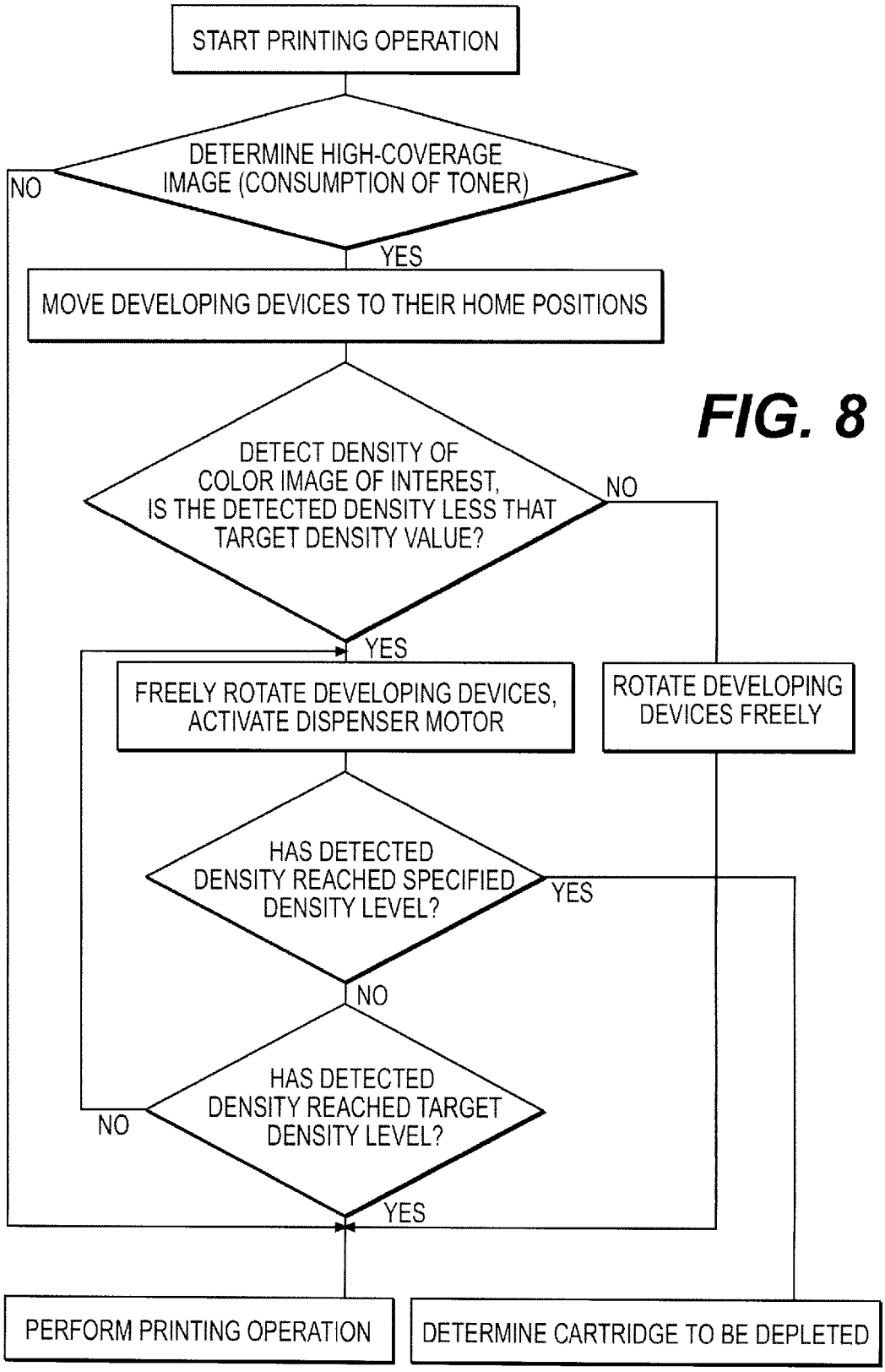
FIG. 8 is a flowchart showing an example of determination of a high-coverage image to be performed during a printing operation.

The image forming apparatus according to the present embodiment performs a cycle down operation during the printing operation, such as that shown in FIG. 8.

If toner is consumed excessively in a case where high-coverage images are continuously printed, picture quality will be deteriorated for reasons of a deficiency of electrical charges of toner or a deficiency of toner. In order to prevent deterioration of picture quality, an image forming apparatus is subjected to temporary cycle down, thereby stabilizing the development property of a developing agent.

As shown in FIG. 8, the CPU 65 commences a printing operation and performs a high-coverage image determination operation as a determination of toner consumption.

Figure 9:
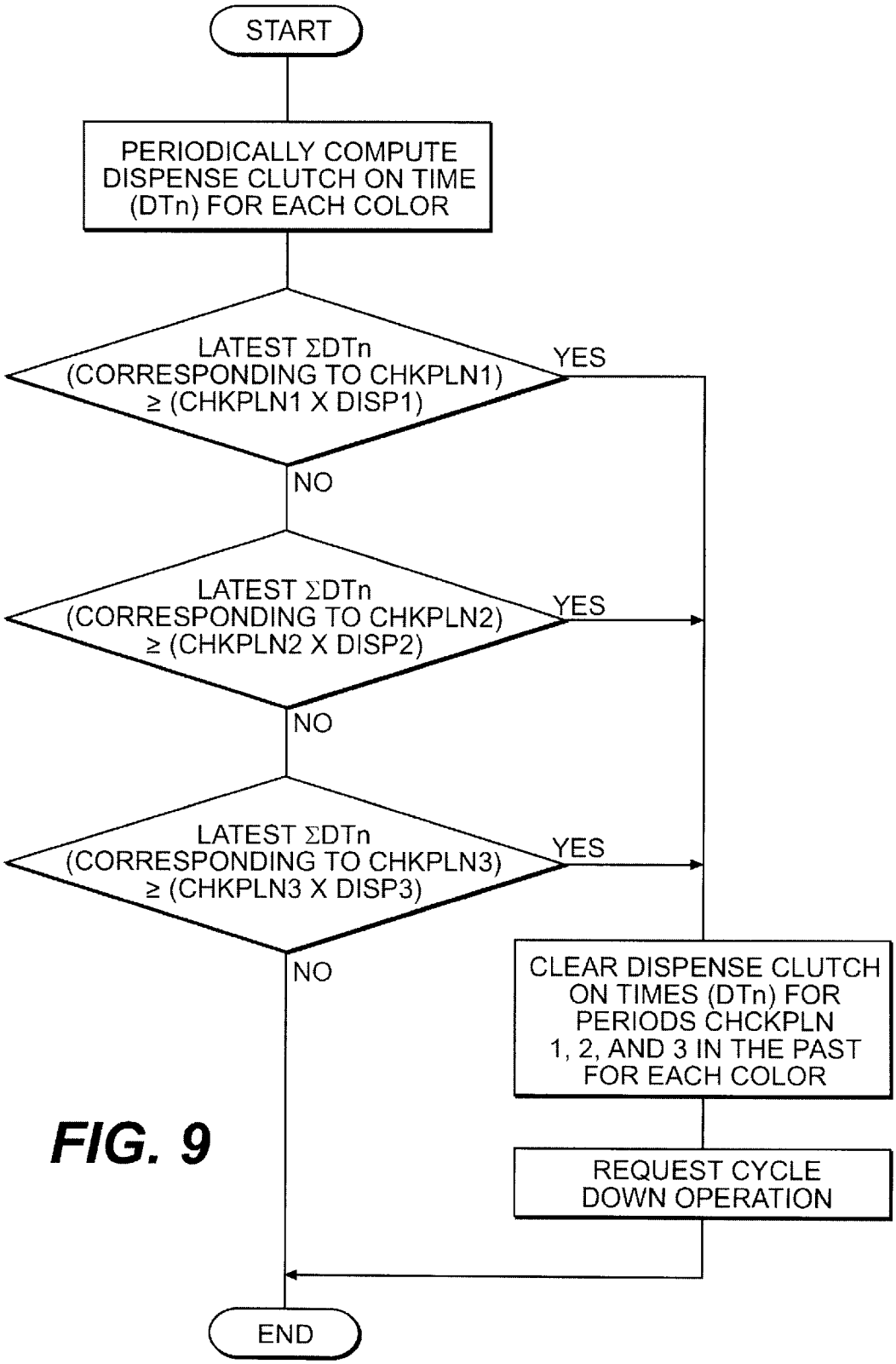
FIG. 9 is a flow chart showing an example of processing pertaining to the high-coverage image determination step shown in FIG. 8.

As shown in FIG. 9, a DISPENSE CLUTCH ON time (DTn) is periodically computed for each color, as the high-coverage image determination operation.

Here, DTn=T(n)−T(n−1)+T_CL.

Figure 10:
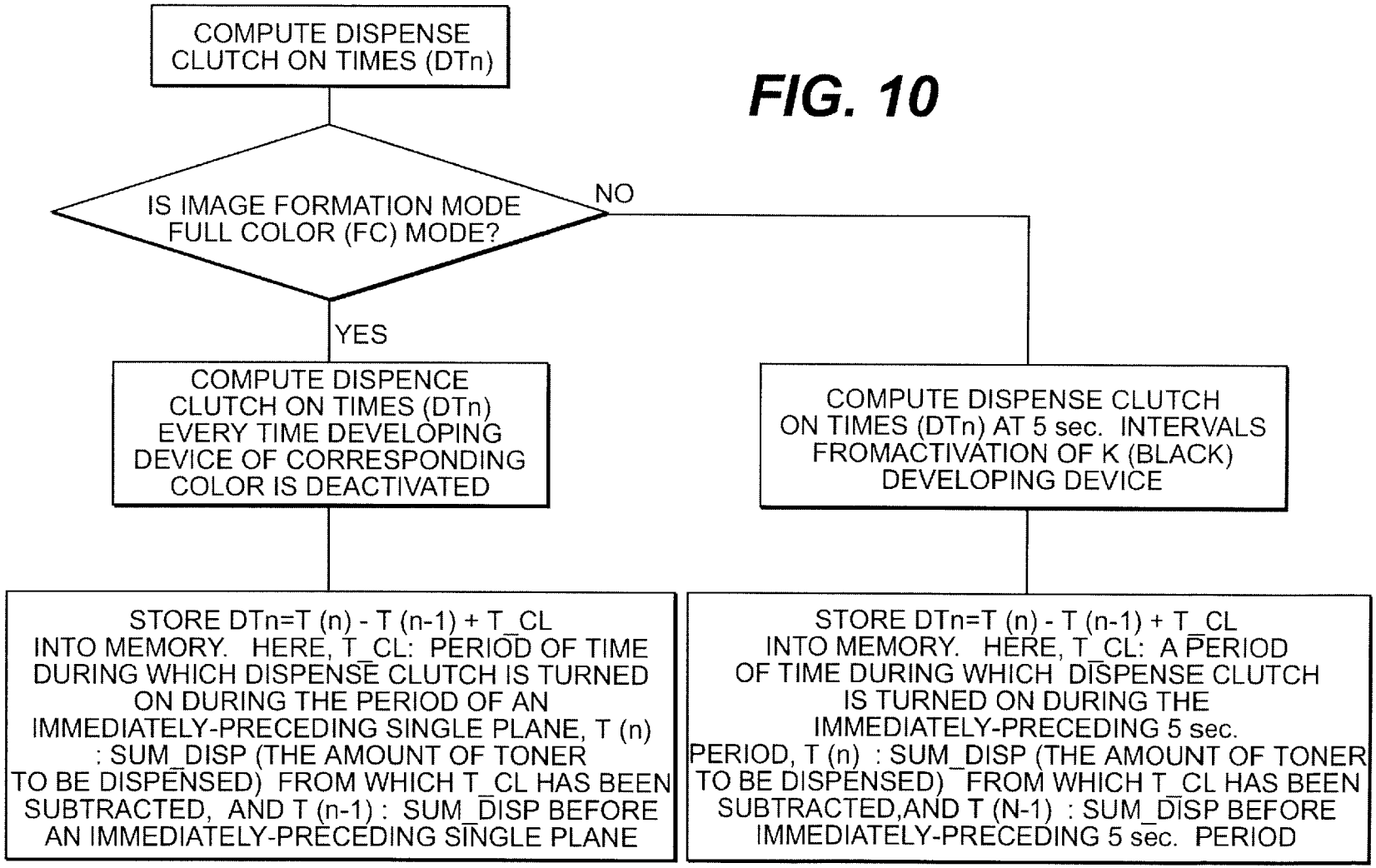
FIG. 10 is flowchart showing an example of computation of DISPENSE CLUTCH ON time DTn shown in FIG. 9.

Details of the computation expression are shown in FIG. 10 and may vary according Lo whether an image formation mode is an FC (full color) mode or a monochrome K (black) mode.

In a case where the image formation mode is an FC mode, a DTn is computed every time the developing device of corresponding color is inoperative, and DTn=T(n)−T(n−1)+T_CL is stored in memory.

Here, T_CL: a period of time during which DISPENSE CLUTCH (dispense clutch) is turned on during the period of an immediately-preceding single PLANE.

T(n) : SUM_DISP (the amount of toner to be dispensed) from which T_CL has been subtracted.

T(n−1) : SUM_DISP before an immediately-preceding single plane.

In contrast, in a case where the image formation mode is a monochrome K (black) mode, a DTn is computed at 5 sec. intervals from activation of a K (black) developing device. DTn=T(n)−T(n−1)+T_CL is stored in memory.

Here, T_CL: a period of time during which DISPENSE CLUTCH (dispense clutch) is turned on during the immediately-preceding 5 sec. period.

T(n) : SUM_DISP (the amount of toner to be dispensed) from which T_CL has been subtracted.

T(n−1): SUM_DISP before immediately-preceding 5 sec. period.

In the present embodiment, a concept of image formation plane is used in the FC mode for superimposing color images one on the other. In contrast with the FC mode, the monochrome K (black) mode does not need to form images on a single image formation plane. Hence, a DTn is grasped as a drive time for image formation (5 sec. in the example).

A check is made as to whether or not the sum total of the latest DISPENSE CLUTCH ON times DTn corresponds to a state in which high-coverage images are continuously printed; that is, a state in which toner is consumed excessively.

In the present embodiment, three periods are prepared as history periods or the past; that is, CHKPLN1 [a short period of time], CHKPL2 [an intermediate period of time], and CHKPLN3 [a long period of time]. Specified unit amounts of toner (DISP1, DISP2, and DISP3) are determined beforehand for the respective three periods. A check is made as to whether or not the sum Total of DISPENSE CLUTCH ON Limes DTn is greater than a boundary condition (CHKPLN1×DISP2) under which excessive consumption of toner arises during a short period of time, a boundary condition (CHKPLN2×DISP2) under which excessive consumption of toner arises during an intermediate period of time, or a boundary condition (CHKPLN3×DISP3) under which excessive consumption of toner arises during a long period of time.

Figure 4:
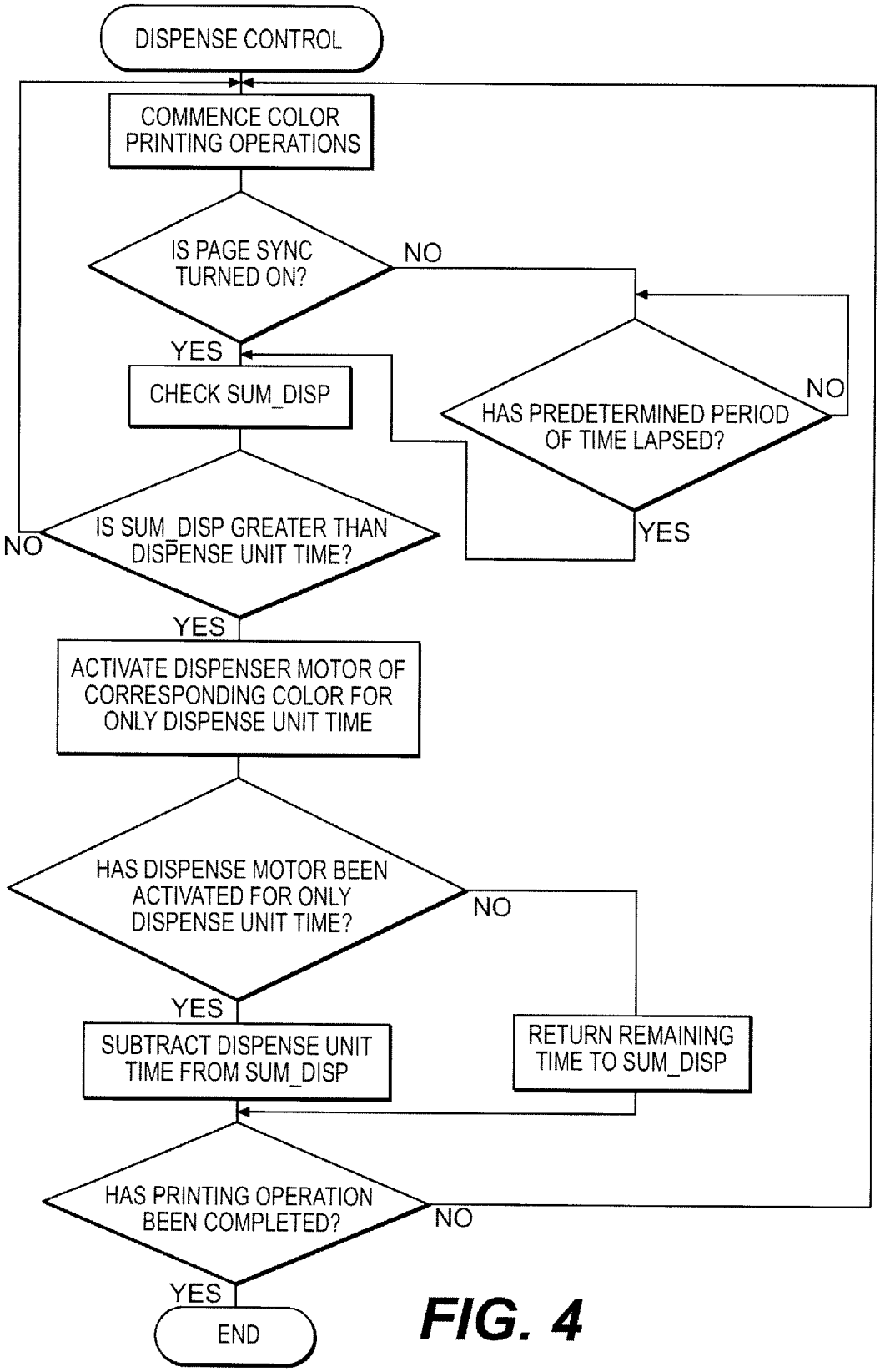
FIG. 4 is a flow chart showing an example of dispense control operation of the toner dispenser employed in the embodiment.

In the present embodiment, SUM_DISP used for computing DTn is accumulated information about the amount of toner to be dispensed. As shown in FIG. 4, the amount of toner which should have been supplied in the past is stored as the amount of deficient toner supply which has not been supplied, and the amount of deficient toner supply is returned to SUM_DISP. Therefore, the amount of toner to be dispensed is expressed more accurately.

Aside from the amount of deficient toner supply, the amount of excessive toner supply which should have been reduced in the past, or the sum of the amount of deficient toner supply and the amount of excessive toner supply, is stored and used as information about a history concerning the amount of toner to be dispensed.

Figure 11A:
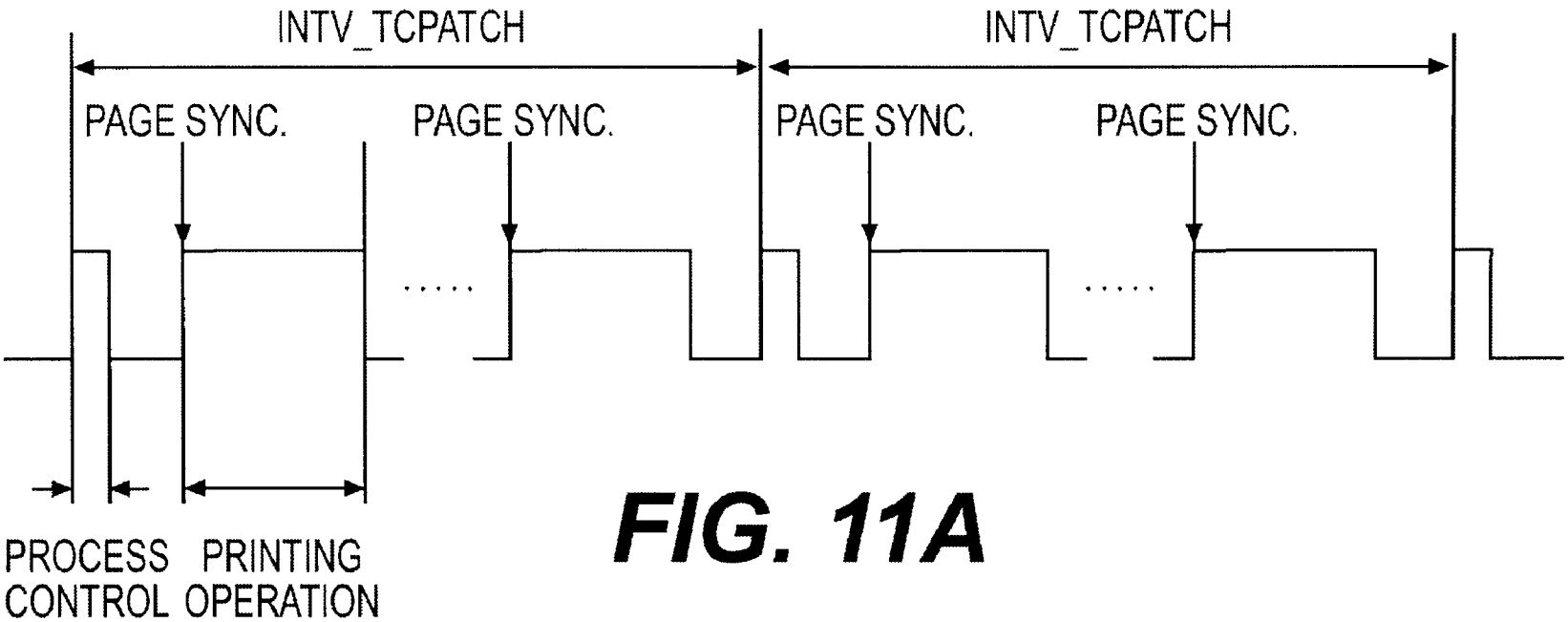
FIG. 11A is a timing chart showing the outline of the dispense control operation employed in the embodiment.
Figure 11B:
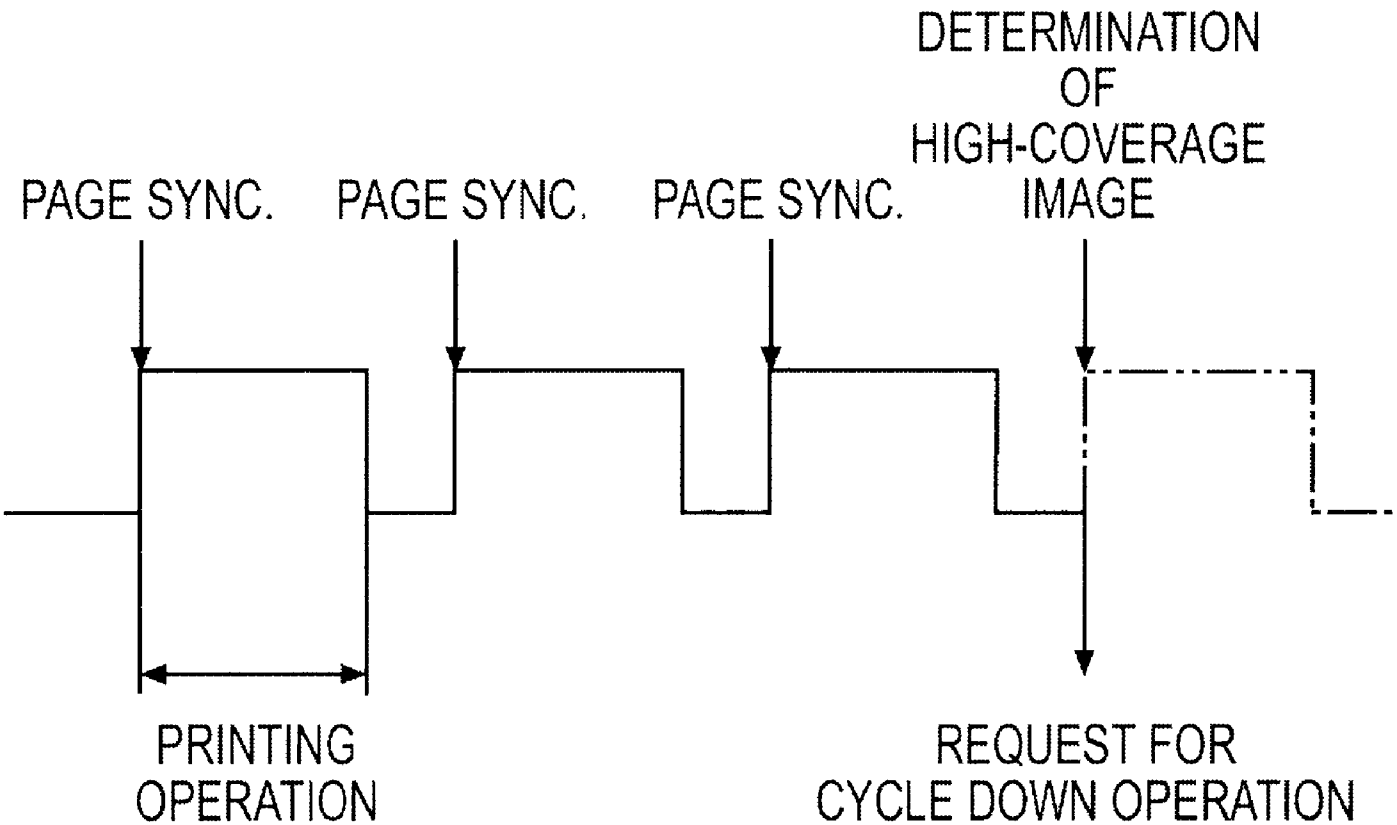
FIG. 11B is a timing chart showing the outline of a high-coverage image determination operation to be performed during a printing operation.

In a case where any of the foregoing requirements is satisfied, the CPU 65 determines that the present state is a high-coverage image state (i.e., excessive consumption or toner), such as that shown in FIG. 11B or a case where high-coverage images are continuously printed. After having cleared the DISPENSE CLUTCH ON times (DTn) for periods CHKPLN 1, 2, and 3 in the past for each color, the CPU 65 demands a cycle down operation.

As shown in FIG. 8, after having moved the developing devices to their home positions, the CPU 65 detects the density of each color (preparation of a reference patch and detection of density of the reference patch) and checks whether or not the density of the reference patch is less than a target density level.

In a case where the density of a reference patch is less than a target density level, the dispenser motor 53 is activated, to thereby supply toner. The augers 43 and 44 in any one of the developing devices 241 to 244 are rotated freely, thereby agitating and blending the supplied toner and the existing developing agent.

The operations are iterated until the density of the reference patch of color of interest reaches a target density level. When the density of the reference patch of the color has reached the target density level, a printing operation is performed. Particularly, in the present embodiment, after an image has been determined to be high coverage, the density of the image on color of interest is detected. Hence, useless replenishment of toner can be avoided.

If the density of the reference patch fails to reach a target density value even after detection of density of the color has been performed a specified number of times, the cartridge is determined to be depleted.

In a case where the density of the reference patch reaches a target density level after first detection of density of a color of interest, a printing operation can be performed. In the present embodiment, from the viewpoint of sustainment or a good electrification property of a developing agent, the augers 43 and 44 provided in a corresponding one of the developing devices 241 to 244 are rotated freely, thus agitating and blending a developing agent. Subsequently, a printing operation is performed.

As has been described above, according to the present invention, the final amount of toner supply is determined on the basis of the standard amount of toner supply corresponding to image density and a change in the amount of toner supply corresponding to the density of an image, thereby controlling toner supply means. In a case where toner is consumed excessively, such as a case where high-coverage images are continuously printed, an electrophotographic image formation process is temporarily interrupted, thereby stabilizing the development property or a developing agent. As a result, a change in environment, a change in the quantity of toner consumed associated with deterioration of a developing agent, and a change in the amount of toner supply corresponding to the amount of toner remaining in a toner storage, such as a toner cartridge, can be reflected on the final amount of toner supply. Thus, the development property of a developing agent can be stabilized in accordance with requirements for actual use.

A variation in the quantity of toner consumed and a variation in the amount of toner supply are taken into consideration without a necessity for setting requirements for interrupting an image formation process and inducing an unnecessary decrease in the productivity of an image forming apparatus (i.e., the number of images formed per unit time). Accordingly, uniform image density can be sufficiently sustained over the development area in the axial direction. In expectation of failures which arise during control of toner supply means on the basis of image coverage: that is, an change in environment, a variation in the quantity of toner consumed, and a variation in the amount of toner supply corresponding to the amount of toner remaining in a toner storage such as a toner cartridge, an image area coverage has hither to been set smaller before hand or there has been previously set a time period after which the process of forming an electrophotographic image is interrupted, thereby deteriorating productivity of the image forming apparatus. However, the present invention obviates such a problem.

What is claimed is:

1. An image forming apparatus, comprising:

a latent image forming unit adapted to form an electrostatic latent image on an image carrier;

a developing unit adapted to render the electrostatic latent image visible through use of a two-component developing agent containing at least a carrier and toner;

a toner supply unit adapted to supply toner to the developing unit;

an image coverage measuring unit adapted to measure an image coverage;

an image density detector adapted to detect the density of an image;

a toner supply controller adapted to determine the final amount of toner supply on the basis of the standard amount of toner supply corresponding to the image coverage measured by said image coverage measuring unit and a change in the amount of toner supply corresponding to the density of an image detected by said image density detector to control said toner supply unit;

a toner supply history storing unit adapted to store a history concerning the amount of toner to be supplied by said toner supply unit;

a toner consumption status determining unit adapted to determine whether or not an excessive amount of toner is consumed, on the basis of the toner supply history information supplied from said toner supply history storing unit; and a development property stabilizing unit adapted to interrupt formation of an image when said toner consumption status determining unit determines that an excessive amount of toner is consumed to cause said toner supply unit to supply toner and to cause the developing unit to agitate and blend a developing agent or to temporarily agitate and blend a developing agent.

2. The image forming apparatus according to claim 1, wherein the amount of toner supply is expressed by a time period during which said toner supply unit is to be activated.

3. The image forming apparatus according to claim 1, wherein said toner supply history storing unit includes a unit for storing the amount of deficient toner supply which should have been supplied in the past but has not been supplied.

4. The image forming apparatus according to claim 1, wherein said toner supply history storing unit includes a unit for storing the amount of excessive toner supply which should have been reduced in the past but has not been reduced.

5. The image forming apparatus according to claim 1, wherein said toner supply history storing unit includes a unit for storing the result of addition of the amount oil deficient toner supply which should have been supplied in the past but has not been supplied and the amount of excessive toner supply which should have been reduced in the past but has not been reduced.

6. The image forming apparatus according to claim 1, wherein said toner consumption determining unit determines excessive consumption of toner in several phases on the basis of a history concerning the amount of toner supplied during different periods of history.

7. The image forming apparatus according to claim 1, wherein, after having interrupted a process of forming an image when said toner consumption determining unit has determined toner consumption as excessive, said development property stabilizing unit detects the density of an image through use of said image density detector, and, in a case where the density of the image does not reach a target density level, said toner supply unit supplies toner, and the developing unit agitates and blends a developing agent or temporarily agitates and blends a developing agent.

8. The image forming apparatus according to claim 7, wherein, after having interrupted a process of forming an image when said toner consumption determining unit has determined toner consumption as excessive, said development property stabilizing unit detects the density of an image through use of said image density detector, and, in a case where the density of the image reaches a target density level, said developing unit temporarily agitates and blends a developing agent.

* * * * *